US009732305B2

(12) United States Patent
Marashi

(10) Patent No.: US 9,732,305 B2
(45) Date of Patent: Aug. 15, 2017

(54) COMPOSITIONS AND METHODS FOR EXTRACTING PERFUME OIL FROM PISTACHIO HULLS

(71) Applicant: Seyed Mohammad Bagher Marashi, Kerman (IR)

(72) Inventor: Seyed Mohammad Bagher Marashi, Kerman (IR)

( * ) Notice: Subject to any disclaimer, the term of this patent is extended or adjusted under 35 U.S.C. 154(b) by 0 days.

(21) Appl. No.: 14/928,182

(22) Filed: Oct. 30, 2015

(65) Prior Publication Data

US 2016/0177223 A1 Jun. 23, 2016

(51) Int. Cl.
*C11B 9/02* (2006.01)
*C11B 9/00* (2006.01)

(52) U.S. Cl.
CPC ..... *C11B 9/027* (2013.01); *C11B 9/0007* (2013.01); *C11B 9/0015* (2013.01); *C11B 9/0019* (2013.01); *C11B 9/0034* (2013.01); *C11B 9/0046* (2013.01); *C11B 9/0049* (2013.01)

(58) Field of Classification Search
CPC ..... C11B 9/027
USPC ..... 512/5
See application file for complete search history.

(56) References Cited

U.S. PATENT DOCUMENTS

| | | | | |
|---|---|---|---|---|
| 6,372,234 | B1 | 4/2002 | Deckers et al. | |
| 8,641,945 | B2 | 2/2014 | Renz et al. | |
| 8,772,216 | B2 | 7/2014 | Volont et al. | |
| 2005/0082157 | A1 * | 4/2005 | Kiran Babu | B01D 3/10 202/83 |
| 2006/0212980 | P1 * | 9/2006 | Parfitt | A01H 5/0825 |
| 2013/0067669 | A1 | 3/2013 | Gonzales et al. | |

OTHER PUBLICATIONS

Chahed, et al. ("Comparison of Pistachio Hull Essential Oils from Different Tunisian Localities", The Italian Journal of Biochemistry, vol. 56 (1), Apr. 2007, pp. 1-5).*

T. Chahed, W. Dhifi, I. Hamrouni, K. Msaada, A. Bellila, M. E. Kchouk and B. Marzouk, "Comparison of pistachio hull essential oils from different tunisian localities" Ital. J. Biochem., Apr. 2007, vol. 56, No. 1, pp. 35-39, The Italian Society of Biochemistry and Molecular Biology, Italy.

* cited by examiner

*Primary Examiner* — Lanee Reuther
(74) *Attorney, Agent, or Firm* — Falati Law Firm

(57) ABSTRACT

A method for extracting an essence or perfume oil from pistachio hulls, the method comprises separating the pistachio green hulls or velvet hulls from pistachio nuts using an industrial separator and subjecting the hulls to an extraction method, which causes release of the essence from essence containing glands, wherein the essence mixes with steam forming vapors. The method further comprises distilling the vapors to form a liquid comprising the essence mixed with an aqueous component and separating the essence from the aqueous component. Compositions and methods for extracting perfume oil from pistachio hulls are described.

3 Claims, 5 Drawing Sheets

COMPOSITIONS AND METHODS FOR EXTRACTING PERFUME OIL FROM PISTACHIO HULLS

BACKGROUND OF THE INVENTION

Natural essences are aromatic chemical compounds that exist in different plants. These essences are identified in a large variety of herbs, flowers, fruits, seeds and other plant material. For centuries now, natural essences constitute one of the areas of interest for human population. In use of plant-based essences, available evidence shows an increase in demand for new essences and related products, especially during the past two decades. The application of aromatic oils or essences in various industries also paved the way for manufacturing of artificial essences. With all existing knowledge and advancements, natural essences retain their special position and status.

Identification and processing or development of new essences is a potential solution to meet the growing demands of the industry and at the same time catering to the needs of diverse range of consumers. Natural essence or aromatics industries, especially the scented oil industry, are continuously looking for specific, new and different essences to gain the attention of their consumers. Because of natural aroma and its constituent compounds, any natural essence is considered unique and organic, thus differentiating from other artificial essences.

Therefore, there exists a need in the art for extraction of essence or perfume oil from natural sources that are not considered artificial. There exists a need for new preparations of a new essence to meet the growing needs of the perfume oil industry, as well as new methods for making use of possible waste products in existing processing of organic products for use in the perfume oil industry.

SUMMARY OF THE INVENTION

The present invention generally relates to the technical field of extraction of perfume oil from natural resources and more particularly relates to methods for extraction of perfume oil or aromatic essence from pistachio green hulls or velvet hulls. The present invention also provides a method of processing pistachio hulls, which are normally regarded as agricultural wastes obtained during harvesting and processing of pistachio nuts.

The present invention relates to methods for extracting essence or perfume oil from pistachio green hulls or velvet hulls using distillation methods or other similar methods.

The present disclosure is directed to a first method for extracting an essence from pistachio hulls, said method comprising: transferring pistachio hulls to a container filled with water and a lid of the container filled with cold water; disrupting the essence containing glands of the pistachio hulls by heat treatment, wherein steam is produced by boiling water and used to extract the essence released from the glands; distilling the essence mixed with the steam followed by cooling to produce a liquid; and recovering the essence by separating an aqueous component from the liquid. In one embodiment, the pistachio hulls comprise pistachio green hull or pistachio velvet hull. In another embodiment, the aqueous component comprises aromatic water.

In one embodiment, the essence comprises perfume oil or essential oil. In one embodiment, the essence comprises at least three or more of DL-limonene, alpha phellandrene, alpha thujene, alpha pinene, alpha terpinolene, delta 3-carene, beta myrcene, acetic acid, bicyclo[2.2.1]heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone. In another embodiment, the essence comprises DL-limonene, alpha phellandrene, alpha thujene, alpha pinene, alpha terpinolene, delta 3-carene, beta myrcene, acetic acid, bicyclo[2.2.1] heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone.

Another aspect of the present disclosure is directed to second method for extracting a perfume oil from pistachio hulls, comprising: transferring pistachio hulls to a steam chamber configured for supplying steam from bottom of the chamber; generating steam and disrupting essence containing glands to release the perfume oil from the glands, wherein the perfume oil is mixed with the steam; directing the steam mixed perfume oil into a condensing column for cooling to form a liquid; and separating the perfume oil and an aqueous component from the liquid. In one embodiment, the essence comprises perfume oil or essential oil.

Another aspect of the present disclosure is directed to a method for processing pistachio hulls, comprising: separating hulls from pistachio nuts using an industrial separator; subjecting hulls to an extraction method which causes release of the essence from essence containing glands, wherein the essence mixes with steam forming vapors; distilling the vapors to form a liquid comprising the essence mixed with an aqueous component; and separating the essence from the aqueous component. In one embodiment, the extraction method comprises a pot distillation method. In another embodiment, the extraction method comprises a steam distillation method. In one embodiment, the aqueous component comprises aromatic water. In another embodiment, the essence comprises perfume oil or essential oil. In another embodiment, the disclosure is directed to an essential oil distilled from at least one green pistachio hull.

In one embodiment, the present invention relates to a first method for extracting an essence from pistachio hulls, the method comprising the steps of: i) transferring the pistachio hulls to a container filled with water and a lid of the container filled with cold water; ii) subjecting the pistachio hulls to heat treatment for disruption of essence containing glands, wherein a steam produced by boiling the water mixes with the essence released from the glands; iii) distilling the essence mixed with the steam followed by cooling produces a liquid; and iv) recovering the essence by separating an aqueous component from the liquid.

In an embodiment, the present invention relates to a second method for extracting a perfume oil from pistachio hulls, the method comprises: transferring the pistachio hulls to a steam chamber configured for supplying steam from bottom of the chamber; disrupting essence containing glands for releasing the perfume oil from the glands, wherein the perfume oil is mixed with the steam; directing the steam mixed perfume oil into a condensing column for cooling to form a liquid; and separating the perfume oil and an aqueous component from the liquid.

In another embodiment, the present invention relates to a method for processing pistachio hulls, the method comprises the steps of: i) separating hulls from pistachio nuts using an industrial separator system; ii) subjecting hulls to a extraction method which causes release of the essence from essence containing glands, wherein the essence mixes with a steam forming vapors; iii) distilling the vapors to form a liquid comprising the essence mixed with an aqueous component; and iv) separating the essence from the aqueous component. The above method of processing pistachio hulls considerably reduced environmental pollution caused by dumping of huge quantities of pistachio hulls as agricultural wastes or dumped in landfills.

One aspect of the present disclosure is directed to a composition comprising six or more of DL-limonene, alpha phellandrene, alpha thujene, alpha pinene, alpha terpinolene, delta 3-carene, beta myrcene, acetic acid, bicyclo[2.2.1] heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone. In one embodiment, the composition is made according to the method of claim 1. In another embodiment, the composition is made according to the method of claim 7. In yet another embodiment, the composition is made according to the method of claim 13.

One aspect of the present disclosure is directed to an essence extracted from pistachio hulls as according to any of the presently taught methods. In one embodiment, said essence comprises six or more of DL-limonene, alpha phellandrene, alpha thujene, alpha pinene, alpha terpinolene, delta 3-carene, beta myrcene, acetic acid, bicyclo[2.2.1] heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone. In another embodiment, said essence comprises DL-limonene, alpha phellandrene, alpha thujene, alpha pinene, alpha terpinolene, delta 3-carene, beta myrcene, acetic acid, bicyclo[2.2.1] heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

Figure 1:
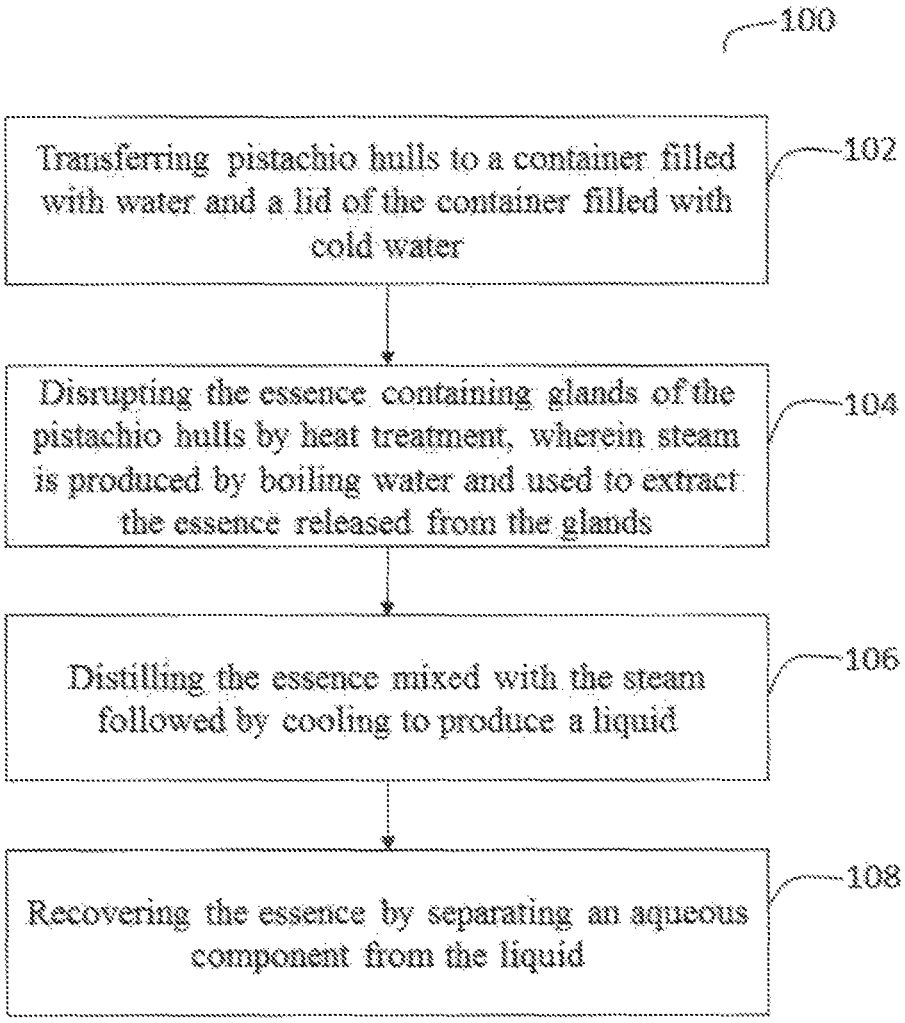
FIG. 1 illustrates a flow diagram, showing a first method of extraction of essence from pistachio hulls.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes that come within the meaning and range of equivalency of claims are to be embraced within their scope.

The terms "pistachio hulls", "hull wastes", "green hulls", or "velvet hulls" are used interchangeably herein refer to the soft hulls covering the bony shells of pistachio.

The terms "perfume", essence, perfume oil, or essential oil are used interchangeably herein and refers to the natural aromatic essence extracted from plants or plant material, specifically from pistachio hulls.

Identification and processing or development of new essences is a potential solution to meet the growing demands of the industry and at the same time catering to the needs of diverse range of consumers. Natural essence or aromatics industries, especially the scented oil industry, are continuously looking for specific, new and different essences to gain the attention of their consumers. Because of the natural aroma and its constituent compounds, any natural essence is considered unique and organic, thus differentiating from other artificial essences.

Large amounts of pistachio green hulls are obtained during harvesting and processing of pistachio nuts. During this process, these hulls are generally regarded as agricultural waste. The pistachio fruit typically grow in clusters on pistachio trees and consists of three main components including nut, bony shell, and green hull or velvet hull. Pistachio nut is normally found encased within the bony shell and the bony shell in covered by a soft hull known as green hull or velvet hull, which is a soft, wet, aromatic hull with a unique essence. During harvesting, the pistachio clusters are collected from trees and subjected to first phase of product processing in which pistachio nuts are separated from green hulls or velvet hulls using stripper devices. The separated green or velvet hulls exit from the processing line and are either used as a fertilizer or disposed as agricultural waste.

Pistachio green hull, contribute to about 42% of fresh pistachio weight, and the approximate quantity of pistachio green hulls obtained during harvesting of nuts exceeds 500 thousand tons yearly. These green hulls are considered to be of limited use, such as for use as fertilizer in gardens or as a worthless product for animal feed. These hulls when dumped as wastes may cause environmental problems and pollution. There is a great need in this field that Applicant is in to find new ways to utilize the pistachio green hull. Due to several technical and economic reasons, huge quantities of pistachio hull wastes are not being utilized to any extent.

Pistachio fruit grows in bunches on pistachio tree; the fruit consists of three main components including nut, bony shell, and green hull or velvet hull. Pistachio nut is present within the bony shell, which is in turn covered by a soft hull with a unique essence, the hull is known as green hull or velvet hull. During harvesting, the pistachio bunches are picked up from the trees and pistachio nuts are separated from green hulls in the first phase of product processing, with the use of stripper devices. Green hulls exit from processing line are used as fertilizer or disposed like agricultural wastes because these hulls are considered as useless.

The present invention provides a solution to the above-mentioned problems of production of new essence from natural plant resources and enhanced utilization of pistachio hull wastes, thus significantly reducing environmental pollution caused by dumping of hulls as agricultural wastes.

The present disclosure is directed to a method for extracting an essence from pistachio hulls. The method comprises transferring pistachio hulls to a container filled with water and a lid of the container filled with cold water. The method further comprises disrupting the essence containing glands of the pistachio hulls by heat treatment, in which steam in used as the source of heat and as a mechanism by which to extract the essence released from the glands. Once the essence is released from the glands and is mixed with the steam, a distillation process is performed on the essence mixed with the steam and a liquid is produced. The final step includes recovering the essence by separating an aqueous component from the liquid. The pistachio hulls may comprise pistachio green hull or pistachio velvet hull. The aqueous component comprises aromatic water.

The essence may comprise perfume oil or essential oil. In one example, the essence comprises at least three or more of DL-limonene, alpha phellandrene, alpha thujene, alpha pinene, alpha terpinolene, delta 3-carene, beta myrcene, acetic acid, bicyclo[2.2.1]heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone. In another example, the essence comprises DL-limonene, alpha phellandrene, alpha thujene, alpha pinene, alpha terpinolene, delta 3-carene, beta myrcene, acetic acid, bicyclo[2.2.1]heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone.

Another aspect of the present disclosure is directed to a method for extracting a perfume oil from pistachio hulls. The method comprises transferring pistachio hulls to a steam chamber configured for supplying steam from bottom of the chamber; and generating steam to disrupt essence-containing glands so that they release the perfume oil from the glands. During this method, the perfume oil is mixed with the steam, and directed into a condensing column for cooling to form a liquid. In a final step, the perfume oil and an aqueous component are separated from the liquid. The essence may comprise perfume oil or essential oil.

Another aspect of the present disclosure is directed to a method for processing pistachio hulls. In this method, pistachio hulls are separated from pistachio nuts using an industrial separator. The hulls are then subjected to an extraction method, which causes release of the essence from essence containing glands, wherein the essence mixes with steam forming vapors. The method further comprises distilling the vapors to form a liquid comprising the essence mixed with an aqueous component, and separating the essence from the aqueous component. The extraction method may comprise a pot distillation method. In another example, the extraction method may comprise a steam distillation method. The aqueous component may comprise aromatic water. The essence may comprise perfume oil or essential oil.

The essence extracted from pistachio hulls comprises a variety of essential oil compounds, which are analyzed using GC-MS (gas chromatography-mass spectroscopy) analysis. The essence comprises DL-limonene, alpha phellandrene, alpha thujene, alpha pinene, alpha terpinolene, delta 3-carene, beta myrcene, acetic acid, bicyclo[2.2.1]heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone.

Referring to FIG. 1, showing a flow diagram of a first method for extracting an essence from pistachio hulls, the method 100 comprise the steps of: i) transferring the pistachio hulls to a container filled with water and a lid of the container filled with cold water, as shown in step 102; ii) disrupting the essence-containing glands of the pistachio hulls by heat treatment, wherein steam is produced by boiling water and used to extract the essence released from the glands, as shown in step 104; iii) distilling the essence mixed with the steam followed by cooling to produce a liquid, as shown in step 106; and iv) recovering the essence by separating an aqueous component from the liquid, as shown in step 108.

The liquid comprises essence oil floating on top portion, above the aqueous component. The essence is separated from the aqueous component using a separating funnel. The aqueous component comprises aromatic water; minor quantities of essence can be recovered from the aromatic water as well. The pistachio hulls comprise green hulls or velvet hulls or both.

Figure 2:
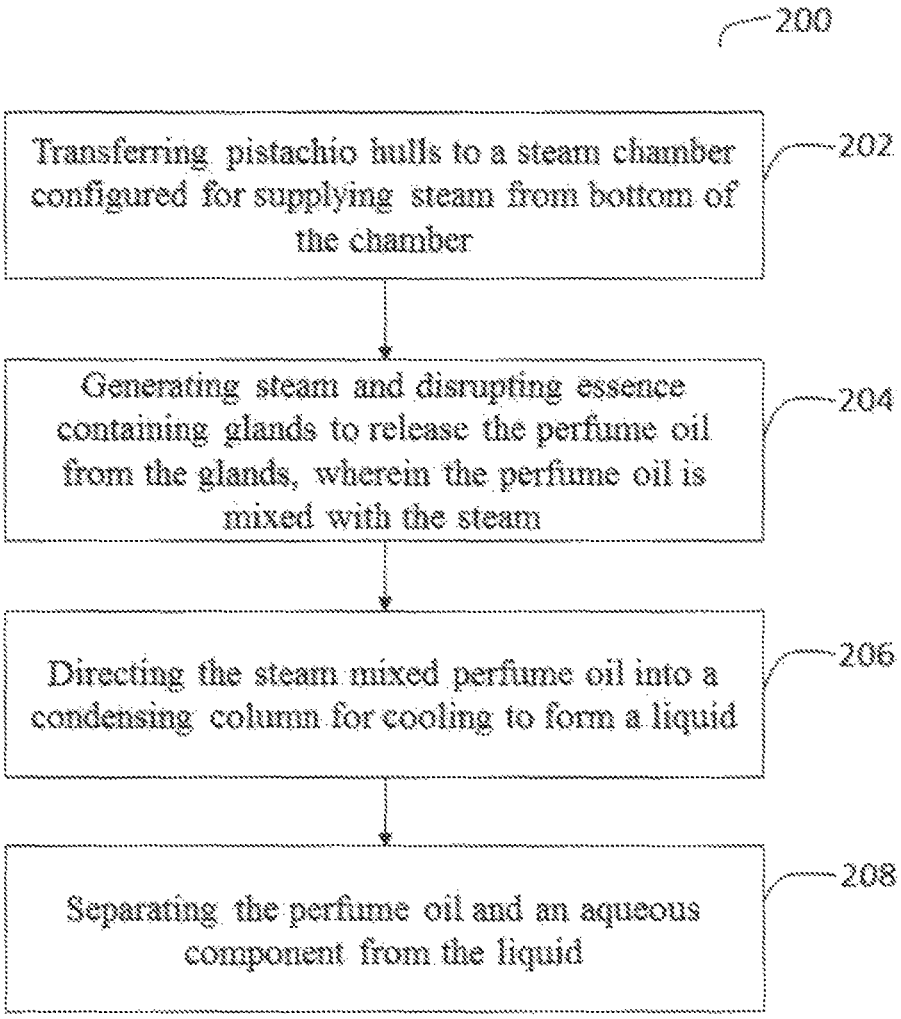
FIG. 2 illustrates a flow diagram, showing a second method of extraction of perfume oil from pistachio hulls.

In another embodiment, a second method for extracting perfume oil from pistachio hulls comprises a steam distillation method. FIG. 2 shows a flow diagram for the second method of extraction, the method 200 comprising the steps of: transferring pistachio hulls to a steam chamber configured for supplying steam from bottom of the chamber, as shown in step 202; generating steam and disrupting essence-containing glands to release the perfume oil from the glands, wherein the perfume oil is mixed with the steam, as shown in step 204; directing the steam mixed perfume oil into a condensing column for cooling to form a liquid, as shown in step 206; and separating the perfume oil and an aqueous component from the liquid, as shown in step 208.

In an exemplary embodiment, hulls of Kalleghuchi pistachio from orchards of Koshkooieh in Rafsanjan city, obtained during the early of harvesting season in Iran, are subjected to extraction of essence using the first method. Pistachio green hull wastes obtained from Shiloo village in Sirjan city are subjected to extraction using the second method.

The essence extracted using the above methods, is subjected to GC-MS analysis. The results of GC-MS analysis indicate that the composition of essential oil compounds present in the essence or perfume oil extracted from pistachio hulls depends on parameters including the kind of pistachio planted, planting situation and harvest time. GC-MS analysis show that the essence extracted from pistachio hulls comprises of the following compounds: DL-limonene, alpha phellandrene, alpha thujene, alpha pinene, alpha terpinolene, delta 3-carene, beta myrcene, acetic acid, bicyclo [2.2.1]heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone.

Table 1 shows the composition of essential oil compounds found in the essence extracted from pistachio hulls. Table 1 shows boiling point and percent composition of each compound obtained using the first and second method of extraction, the compounds listed below in the order of abundance.

TABLE 1

| S. no | Name of the compound | Boiling Point | Percent Material obtained using First method | Percent Material obtained using Second method |
|---|---|---|---|---|
| 1 | DL-limonene | 176 | 61.08 | 61.34 |
| 2 | alpha phellandrene | 171-172 | 11.65 | 14.89 |
| 3 | alpha thujene | | | |
| 4 | alpha pinene | 155 | 8.11 | 7.96 |
| 5 | alpha terpinolene | 185 | 7.8 | 5.99 |
| 6 | delta 3-carene | 169-167 | 1.82 | 1.14 |
| 7 | beta mycrene | 168-166 | 1.79 | 1.88 |
| 8 | acetic acid | 119-118 | 1.79 | 1.37 |

TABLE 1-continued

| S. no | Name of the compound | Boiling Point | Percent Material obtained using First method | Percent Material obtained using Second method |
|---|---|---|---|---|
| 9 | bicyclo[2.2.1]heptan-2-ol | | | |
| 10 | camphene | 159 | 1.62 | 1.72 |
| 11 | beta pinene | 167-165 | 1.47 | 1.74 |
| 12 | gamma terpinene | 183 | 0.80 | 0.48 |
| 13 | 3-cyclohexen-1-ol | | 0.66 | 0 |
| 14 | alpha terpinene | 174.8-173.5 | 0.54 | 0.38 |
| 15 | sabinene | 164-163 | 0.35 | 9.63 |
| 16 | 1,3,6-octatriene | | 0.35 | 0.32 |
| 17 | (+)-4-carene<br>(+)-2-carene | | 0.16 | 0 |
| 18 | 2-pentadecanone | | 0 | 0.16 |

The GC-MS analysis of the essence extracted from pistachio hulls indicates that the quality percentage of essential oil compounds present in the extracted essence depends on factors such as, the kind of pistachio, planting situation and time of harvest. The difference in essential oil compounds composition amounts to a maximum of five percent.

Figure 3:
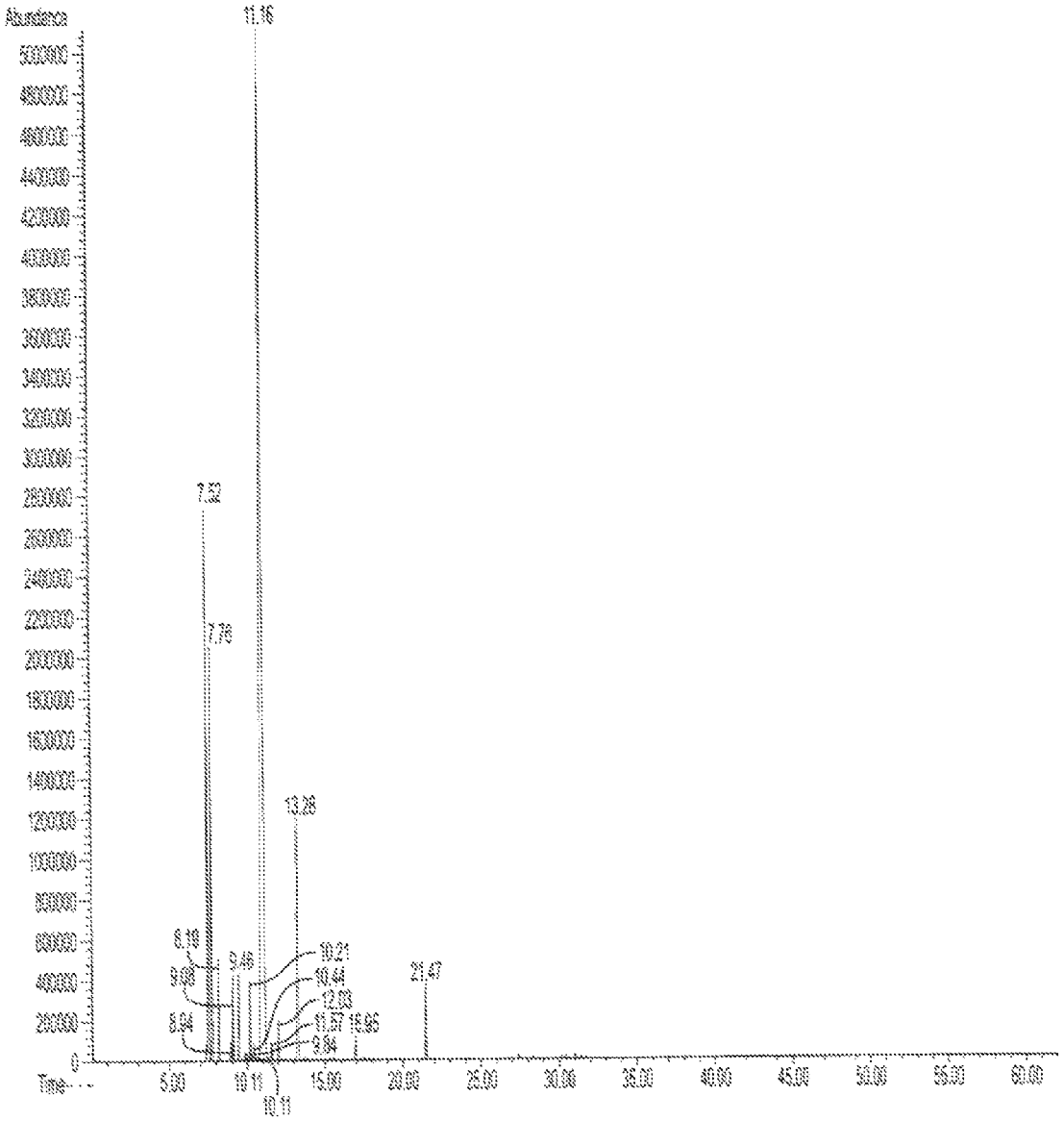
FIG. 3 shows a chromatogram of the analysis by gas chromatography and mass spectrometry of the essence obtained from pistachio hulls using the first method of extraction.

FIG. 3 shows a chromatogram of the analysis by gas chromatography and mass spectrometry of the essence obtained using the first method. The data for each peak in this chromatogram is given in the following Table 2.

Information from Data File:

File: C:\MSDCHEM\1\DATA\DATA 93.8.24\EBRAHIM5.D

Operator: Ebrahimabadi

Date Acquired: 13 Nov. 2014 23:50

Method File: ALSO2

Sample Name: psr2

Misc Info:

Vial Number: 2

Search Libraries: C:\DATABASE\wiley7n.L Minimum Quality: 0

Unknown Spectrum: Apex

Integration Events: Chemstation Integrator-events.e

TABLE 2

| Pk# | RT | Area % | Library/ID | Ref# | CAS# | Qual |
|---|---|---|---|---|---|---|
| 1 | 7.52 | 11.65 | C:\DATABASE\wiley7n.L | | | |
| | | | .ALPHA.PHELLANDRENE | 32342 | 001529-99-3 | 96 |
| | | | .alpha.-Thujene$$ Bicyclo[3.1 . . . | 32142 | 002867-05-2 | 94 |
| | | | .alpha.-Thujene$$ Bicyclo[3.1 . . . | 32145 | 002867-05-2 | 94 |
| 2 | 7.76 | 8.11 | C:\DATABASE\wiley7n.L | | | |
| | | | .ALPHA.-PINENE(−)-$$ Bicyclo . . . | 32185 | 000080-56-8 | 97 |
| | | | Bicyclo[3.1.1]hept-2-ene,2,6,6 . . . | 32419 | 002437-95-8 | 97 |
| | | | .ALPHA.-PINENE(−)-$$ Bicyclo . . . | 32184 | 000080-56-8 | 96 |
| 3 | 8.19 | 1.62 | C:\DATABASE\wiley7n.L | | | |
| | | | Camphene$$ Bicyclo[2.2.1]hepta . . . | 32117 | 000079-92-5 | 98 |
| | | | Camphene$$ Bicyclo[2.2.1]hepta . . . | 32125 | 000079-92-5 | 98 |
| | | | Camphene$$ Bicyclo[2.2.1]hepta . . . | 32126 | 000079-92-5 | 97 |
| 4 | 8.94 | 0.35 | C:\DATABASE\wiley7n.L | | | |
| | | | Sabinene$$ Bicyclo[3.1.0]hexan . . . | 32164 | 003387-41-5 | 96 |
| | | | Sabinene$$ Bicyclo[3.1.0]hexan . . . | 32163 | 003387-41-5 | 96 |
| | | | Sabinene$$ Bicyclo[3.1.0]hexan . . . | 32156 | 003387-41-5 | 94 |
| 5 | 9.08 | 1.47 | C:\DATABASE\wiley7n.L | | | |
| | | | Bicyclo[3.1.1]heptane,6,6-dime . . . | 32196 | 018172-67-3 | 97 |
| | | | .beta.-Pinene | 32209 | 000127-91-3 | 97 |
| | | | 2-.BETA.-PINENE$$ Bicyclo[3.1 . . . | 32213 | 000127-91-3 | 96 |
| 6 | 9.46 | 1.79 | C:\DATABASE\wiley7n.L | | | |
| | | | .beta.-Myrcene$$ 1,6-Octadiene . . . | 31858 | 000123-35-3 | 96 |
| | | | .beta.-Myrcene$$ 1,6-Octadiene . . . | 31861 | 000123-35-3 | 95 |
| | | | .beta.-Myrcene$$ 1,6-Octadiene . . . | 31871 | 000123-35-3 | 95 |
| 7 | 9.84 | 0.16 | C:\DATABASE\wiley7n.L | | | |
| | | | (+)-4-Carene | 32434 | 029050-33-7 | 98 |
| | | | (+)-2-CARENE | 32361 | 000000-00-0 | 98 |
| | | | .alpha.-Terpinene$$1,3-Cycloh . . . | 31897 | 000099-86-5 | 97 |
| 8 | 10.21 | 1.82 | C:\DATABASE\wiley7n.L | | | |
| | | | .DELTA.3-Carene$$ Bicyclo[4.1 . . . | 32244 | 013466-78-9 | 97 |
| | | | 3-Carene | 32233 | 013466-78-9 | 96 |
| | | | .DELTA.3-Carene$$ Bicyclo[4.1 . . . | 32232 | 013466-78-9 | 96 |
| 9 | 10.44 | 0.54 | C:\DATABASE\wiley7n.L | | | |
| | | | .alpha.-Terpinene$$ 1,3-Cycloh . . . | 31909 | 000099-86-5 | 98 |
| | | | .alpha.-Terpinene$$ 1,3-Cycloh . . . | 31901 | 000099-86-5 | 98 |
| | | | .alpha.-Terpinene$$ 1,3-Cycloh . . . | 31906 | 000099-86-5 | 98 |
| 10 | 11.16 | 61.08 | C:\DATABASE\wiley7n.L | | | |
| | | | dl-Limonene$$ Cyclohexene, 1-m . . . | 31986 | 000138-86-3 | 99 |
| | | | dl-Limonene$$ Cyclohexene, 1-m . . . | 31993 | 000138-86-3 | 98 |
| | | | l-Limonene$$ Cyclohexene, 1-me . . . | 32008 | 005989-54-8 | 97 |
| 11 | 11.57 | 0.35 | C:\DATABASE\wiley7n.L | | | |
| | | | 1,3,6-Octatriene,3,7-dimethyl- . . . | 31804 | 003779-61-1 | 98 |
| | | | 1,3,7-Octatriene,3,7-dimethyl- | 31830 | 000502-99-8 | 97 |
| | | | 1,3,6-Octatriene,3,7-dimethyl- . . . | 31808 | 003779-61-1 | 94 |
| 12 | 12.03 | 0.80 | C:\DATABASE\wiley7n.L | | | |
| | | | .gamma.-Terpinene$$ 1,4-Cycloh . . . | 31961 | 000099-85-4 | 97 |
| | | | .gamma.-Terpinene$$ 1,4-Cycloh . . . | 31949 | 000099-85-4 | 96 |
| | | | .gamma.-Terpinene$$ 1,4-Cycloh . . . | 31963 | 000099-85-4 | 96 |

TABLE 2-continued

| Pk# | RT | Area % | Library/ID | Ref# | CAS# | Qual |
|---|---|---|---|---|---|---|
| 13 | 13.28 | 7.80 | C:\DATABASE\wiley7n.L | | | |
| | | | .ALPHA.-TERPINOLENE$$ Cyclohex . . . | 32030 | 000586-62-9 | 98 |
| | | | .ALPHA.-TERPINOLENE$$ Cyclohex . . . | 32042 | 000586-62-9 | 98 |
| | | | .ALPHA.-TERPINOLENE$$ Cyclohex . . . | 32041 | 000586-62-9 | 98 |
| 14 | 16.95 | 0.66 | C:\DATABASE\wiley7n.L | | | |
| | | | 3-Cyclohexen-1-ol,4-methyl-1-( . . . | 52812 | 000562-74-3 | 97 |
| | | | 3-Cyclohexen-1-ol,4-methyl-1-( . . . | 52820 | 000562-74-3 | 95 |
| | | | 3-Cyclohexen-1-ol,4-methyl-1-( . . . | 52813 | 000562-74-3 | 93 |
| 15 | 21.48 | 1.79 | C:\DATABASE\wiley7n.L | | | |
| | | | Bicyclo[2.2.1]heptan-2-ol,1,7, . . . | 109571 | 005655-61-8 | 99 |
| | | | Bicyclo[2.2.1]heptan-2-ol,1,7, . . . | 109570 | 005655-61-8 | 99 |
| | | | Aceticacid, 1,7,7-trimethyl-bi . . . | 109817 | 092618-89-8 | 99 |

Figure 4:
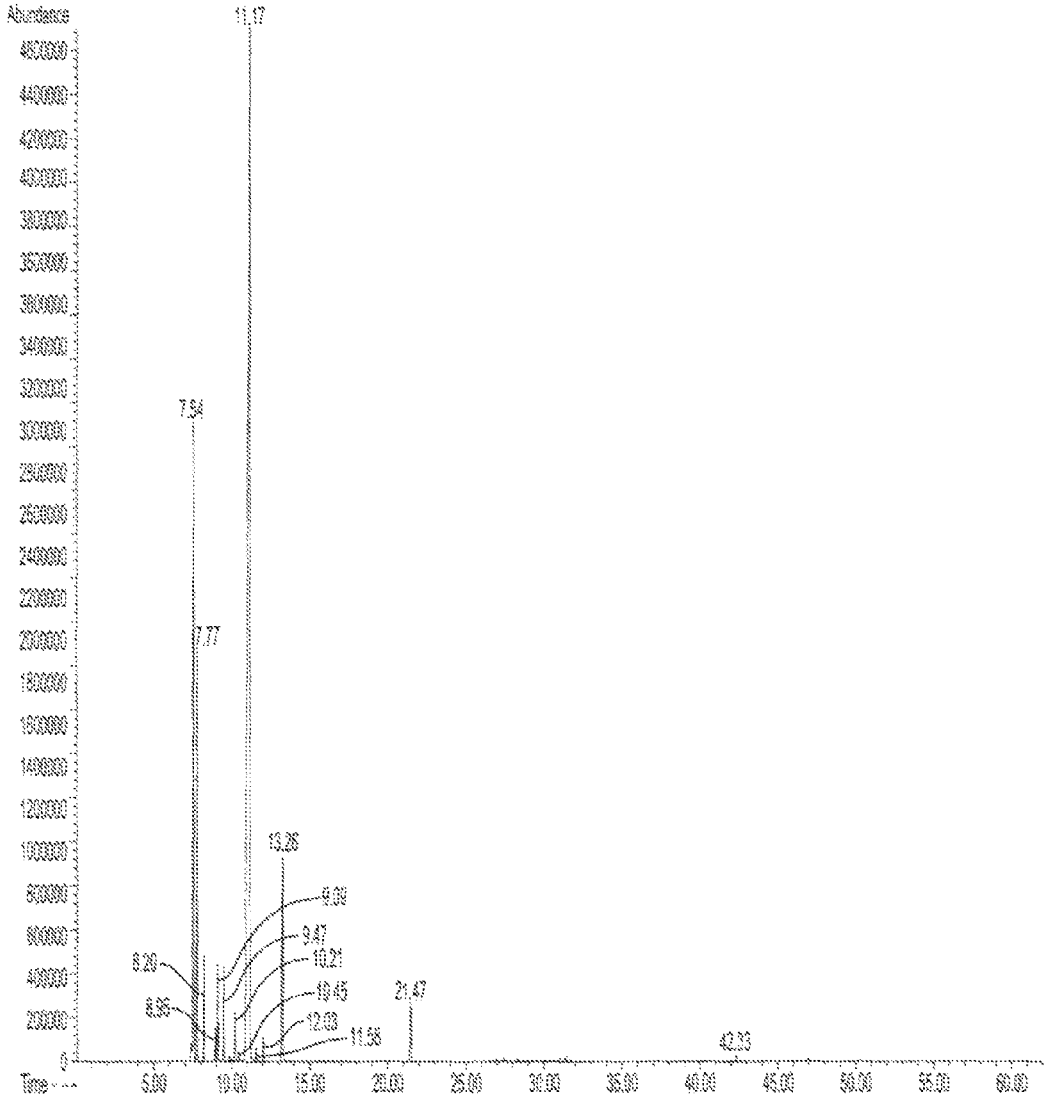
FIG. 4 shows a chromatogram of the analysis by gas chromatography and mass spectrometry of the essence obtained from pistachio hulls using the second method of extraction.

FIG. 4 shows a chromatogram of the analysis by gas chromatography and mass spectrometry of the essence obtained using the second method. The data for each peak in this chromatogram is given in the following Table 3.

Information from Data File:

File: C:\MSDCHEM\1\DATA\DATA 93.8.24\EBRAHIM4.D

Operator: Ebrahimabadi

Date Acquired: 13 Nov. 2014 18:38

Method File: ALSO2

Sample Name: psr1

Misc Info:

Vial Number: 1

Search Libraries: C:\DATABASE\wiley7n.L Minimum Quality: 0

Unknown Spectrum: Apex

Integration Events: Chemstation Integrator-events.e

TABLE 3

| Pk# | RT | Area % | Library/ID | Ref# | CAS# | Qual |
|---|---|---|---|---|---|---|
| 1 | 7.54 | 14.89 | C:\DATABASE\wiley7n.L | | | |
| | | | .ALPHAPHELLANDRENE | 32342 | 001529-99-3 | 95 |
| | | | .alpha.-Thujene$$ Bicyclo[3.1 . . . | 32142 | 002867-05-2 | 94 |
| | | | .alpha.-Thujene$$Bicyclo[3.1 . . . | 32145 | 002867-05-2 | 94 |
| 2 | 7.77 | 7.96 | C:\DATABASE\wiley7n.L | | | |
| | | | .ALPHA.-PINENE(−)-$$ Bicyclo . . . | 32185 | 000080-56-8 | 97 |
| | | | .ALPHA.-PINENE(−)-$$ Bicyclo . . . | 32184 | 000080-56-8 | 96 |
| | | | .ALPHA.-PINENE(−)-$$ Bicyclo . . . | 32180 | 000080-56-8 | 96 |
| 3 | 8.20 | 1.72 | C:\DATABASE\wiley7n.L | | | |
| | | | Camphene$$Bicyclo[2.2.1]hepta . . . | 32125 | 000079-92-5 | 98 |
| | | | Camphene$$Bicyclo[2.2.1]hepta . . . | 32117 | 000079-92-5 | 98 |
| | | | Camphene$$Bicyclo[2.2.1]hepta . . . | 32126 | 000079-92-5 | 97 |
| 4 | 8.95 | 0.63 | C:\DATABASE\wiley7n.L | | | |
| | | | Sabinene$$Bicyclo[3.1.0]hexan . . . | 32163 | 003387-41-5 | 96 |
| | | | Sabinene$$Bicyclo[3.1.0]hexan . . . | 32164 | 003387-41-5 | 96 |
| | | | Sabinene$$Bicyclo[3.1.0]hexan . . . | 32157 | 003387-41-5 | 95 |
| 5 | 9.09 | 1.74 | C:\DATABASE\wiley7n.L | | | |
| | | | Bicyclo[3.1.1]heptane,6,6-dime . . . | 32196 | 018172-67-3 | 97 |
| | | | .beta.-Pinene | 32209 | 000127-91-3 | 97 |
| | | | 2-.BETA.-PINENE$$ Bicyclo[3.1 . . . | 32213 | 000127-91-3 | 96 |
| 6 | 9.47 | 1.88 | C:\DATABASE\wiley7n.L | | | |
| | | | .beta.-Myrcene$$ 1,6-Octadiene . . . | 31858 | 000123-35-3 | 96 |
| | | | .beta.-Myrcene$$ 1,6-Octadiene . . . | 31854 | 000123-35-3 | 95 |
| | | | .beta.-Myrcene$$ 1,6-Octadiene . . . | 31867 | 000123-35-3 | 94 |
| 7 | 10.21 | 1.14 | C:\DATABASE\wiley7n.L | | | |
| | | | .DELTA.3-Carene$$ Bicyclo[4.1 . . . | 32244 | 013466-78-9 | 98 |
| | | | .DELTA3 CARENE | 32339 | 013466-78-9 | 97 |
| | | | .DELTA.3-Carene$$ Bicyclo[4.1 . . . | 32237 | 013466-78-9 | 96 |
| 8 | 10.44 | 0.38 | C:\DATABASE\wiley7n.L | | | |
| | | | .alpha.-Terpinene$$ 1,3-Cycloh . . . | 31906 | 000099-86-5 | 98 |
| | | | .alpha.-Terpinene$$ 1,3-Cycloh . . . | 31901 | 000099-86-5 | 98 |
| | | | .alpha.-Terpinene$$ 1,3-Cycloh . . . | 31909 | 000099-86-5 | 98 |
| 9 | 11.17 | 61.34 | C:\DATABASE\wiley7n.L | | | |
| | | | dl-Limonene$$ Cyclohexene,1-m . . . | 31986 | 000138-86-3 | 99 |
| | | | dl-Limonene$$ Cyclohexene,1-m . . . | 31993 | 000138-86-3 | 98 |
| | | | l-Limonene$$ Cyclohexene,1-m . . . | 32008 | 005989-54-8 | 97 |
| 10 | 11.58 | 0.32 | C:\DATABASE\wiley7n.L | | | |
| | | | 1,3,6-Octatriene,3,7-dimethyl- . . . | 31804 | 003779-61-1 | 96 |
| | | | Z-.beta.-ocimene | 32323 | 000000-00-0 | 94 |
| | | | 1,3,7-Octatriene,3,7-dimethyl- | 31830 | 000502-99-8 | 94 |
| 11 | 12.03 | 0.48 | C:\DATABASE\wiley7n.L | | | |
| | | | .gamma.-Terpinene$$ 1,4-Cycloh . . . | 31963 | 000099-85-4 | 96 |
| | | | .gamma.-Terpinene$$ 1,4-Cycloh . . . | 31949 | 000099-85-4 | 96 |
| | | | .gamma.-Terpinene$$ 1,4-Cycloh . . . | 31955 | 000099-85-4 | 96 |

TABLE 3-continued

| Pk# | RT | Area % | Library/ID | Ref# | CAS# | Qual |
|---|---|---|---|---|---|---|
| 12 | 13.26 | 5.99 | C:\DATABASE\wiley7n.L | | | |
| | | | .ALPHA.-TERPINOLENE$$ Cyclohex . . . | 32042 | 000586-62-9 | 98 |
| | | | .ALPHA.-TERPINOLENE$$ Cyclohex . . . | 32041 | 000586-62-9 | 98 |
| | | | .ALPHA.-TERPINOLENE$$ Cyclohex . . . | 32033 | 000586-62-9 | 98 |
| 13 | 21.47 | 1.37 | C:\DATABASE\wiley7n.L | | | |
| | | | Bicyclo[2.2.1]heptan-2-ol,1,7, . . . | 109568 | 005655-61-8 | 99 |
| | | | Bicyclo[2.2.1]heptan-2-ol,1,7, . . . | 109571 | 005655-61-8 | 99 |
| | | | ENDOBORNYLACETATE$$ Bicyclo[2 . . . | 109585 | 000076-49-3 | 98 |
| 14 | 42.33 | 0.16 | C:\DATABASE\wiley7n.L | | | |
| | | | 2-Pentadecanone,6,10,14-trimet . . . | 211397 | 000502-69-2 | 87 |
| | | | 2-Pentadecanone,6,10,14-trimet . . . | 211395 | 000502-69-2 | 72 |
| | | | 2,6-HEPTADIONE$$ 2,6-Heptanedi . . . | 24368 | 013505-34-5 | 53 |

Figure 5:
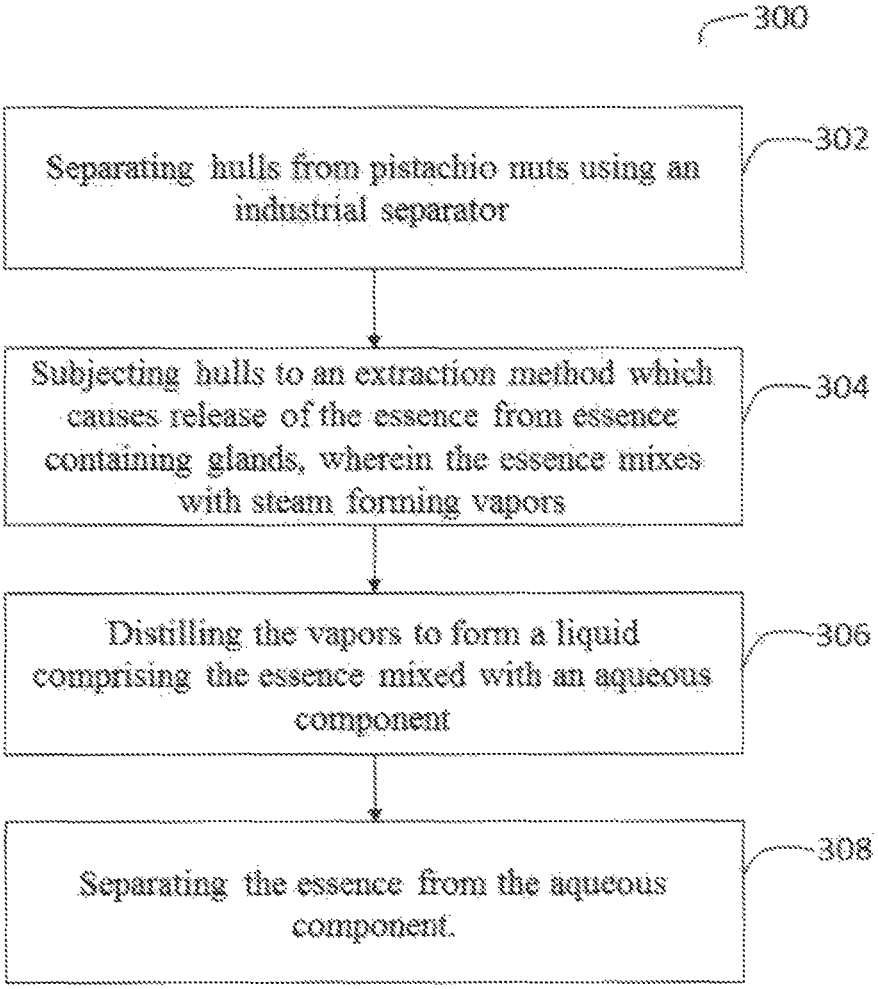
FIG. 5 illustrates a flow diagram, showing a method for processing of the pistachio hulls.

FIG. 5 illustrates one embodiment, illustrating a method for processing pistachio hulls. The method 300 comprises the steps of: i) separating hulls from pistachio nuts using an industrial separator system, as shown in step 302; ii) subjecting hulls to a extraction method which causes release of the essence from essence containing glands, wherein the essence mixes with steam forming vapors, as shown in step 304; iii) distilling the vapors to form a liquid comprising the essence mixed with an aqueous component, as shown in step 306; and iv) separating the essence from the aqueous component, as shown in step 308. The above method of processing pistachio hulls considerably reduced environmental pollution caused by dumping of huge quantities of pistachio hulls as agricultural wastes or as landfills. The extraction method may involve pot still distillation and/or steam distillation method. The pistachio hulls may comprise green hulls or velvet hulls.

According to an embodiment, the essence from pistachio green hulls are extracted using different methods as mentioned in the following. In one example, a distillation method is used to produce the essence. For example, simple distillation, water distillation, water and steam distillation, distillation with steam and an organic solvent simultaneously, dessert mobile distillation, portable pilot unit of essence extraction, vacuum distillation, permanent distillation, turning distillation, distillation in moving pots, dissociative distillation, fractional distillation, and similar methods of distillation can be used.

In a second example, a scrape, pressure and scarify method is used to extract the essence from the pistachio green hulls. For example, in this second method, the methods of sponge, scarify and puncturing method, rasp methods, mechanical methods, cold pressure, and the like are used.

A third alternative option is the extraction method using solvent. essence extraction with solvent divides into two parts: first, the essence is extracted with volatile solvent and second, essence is extracted with non-volatile solvents. For example, the Enfleurage extraction technique and air soaking method.

In other alternatives, extraction using hydrolysis enzymes is used; essence extraction by methods using supercritical fluid (CO2); and essence extraction using ultrasonic energy are used.

The essence extracted according to the present invention have abundant usage, as there is a constant requirement for new and innovative fragrances in the perfume industry. Another application of the essence ingredients involves cosmetic industry, especially in the production of lotions, cosmetic creams, talcum powders, deodorant, saponification agents, detergents, toothpaste, and the like.

The essence from pistachio hulls can also be used in the production of medicinal drugs (ex: aromatherapy) and pharmaceutical products such as syrups, creams, disinfectants, ointments, lotions, etc. The constituent ingredients of the essence are used in the food industry, especially for manufacture of products such as aromatic chewing gum, food products, food additives, flavors and natural preservatives. Chemical precursors are required for producing a number of industrial chemicals, such as production of insecticides, pesticides, botanical pesticides, plastic materials, etc.

One aspect of the present disclosure is directed to a composition comprising six or more of DL-limonene, alpha phellandrene, alpha thujene, alpha pinene, alpha terpinolene, delta 3-carene, beta myrcene, acetic acid, bicyclo[2.2.1] heptan-2-ol, camphene, beta pinene, gamma terpinene, 3-cyclohexen-1-ol, alpha terpinene, sabinene, 1,3,6-octatriene, (+)-4-carene, (+)-2-carene and 2-pentadecanone. The composition of the present disclosure may be made according to the method of claim 1. In one example, the composition of the present disclosure can made according to the method of claim 7. The composition of the present disclosure may also be made according to the method of claim 13.

Other advantages of the present invention include but not limited to: i) unique composition of essential oil compounds contributes to the special fragrance of the essence; ii) utilization of pistachio hull wastes as raw material for production of perfume oil results in considerable reduction of hull wastes, which otherwise would be dumped leading to environmental pollution; iii) low cost of production due to usage of agricultural waste (hull waste) as raw material for extraction of essence; and iv) potential for production of high volume of essence comparing to other essences, as pistachio harvesting results in huge quantities of hull wastes.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention.

Merely listing or numbering the steps of a method in a certain order does not constitute any limitation about the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A method for extracting a perfume oil from fresh pistachio green or velvet hulls, comprising:

transferring fresh pistachio green or velvet hulls to a steam chamber configured for supplying steam from bottom of the chamber;

generating steam and disrupting perfume oil containing glands to release the perfume oil from the glands, wherein the perfume oil is mixed with the steam;

directing the steam mixed perfume oil into a condensing column for cooling to form a liquid; and separating the perfume oil and an aqueous component from the liquid, wherein the perfume oil comprises sabinene in the amount of about 10% by weight.

2. The method of claim 1, wherein the aqueous component comprises aromatic water.

3. The method of claim 1, wherein the perfume oil comprises essential oil.

* * * * *